US011663921B2

(12) United States Patent
Yang et al.

(10) Patent No.: US 11,663,921 B2
(45) Date of Patent: May 30, 2023

(54) FLIGHT TRAJECTORY MULTI-OBJECTIVE DYNAMIC PLANNING METHOD

(71) Applicant: THE 28TH RESEARCH INSTITUTE OF CHINA ELECTRONICS TECHNOLOGY GROUP CORPORATION, Nanjing (CN)

(72) Inventors: Shangwen Yang, Nanjing (CN); Shenghao Fu, Nanjing (CN); Lu Jiang, Nanjing (CN); Jibo Huang, Nanjing (CN)

(73) Assignee: THE 28TH RESEARCH INSTITUTE OF CHINA ELECTRONICS TECHNOLOGY GROUP CORPORATION, Nanjing (CN)

( * ) Notice: Subject to any disclaimer, the term of this patent is extended or adjusted under 35 U.S.C. 154(b) by 0 days.

(21) Appl. No.: 17/813,171

(22) Filed: Jul. 18, 2022

(65) Prior Publication Data

US 2022/0375352 A1 Nov. 24, 2022

Related U.S. Application Data

(63) Continuation of application No. PCT/CN2022/097768, filed on Jun. 9, 2022.

(30) Foreign Application Priority Data

Aug. 18, 2021 (CN) ..... 202110947594

(51) Int. Cl.
*G08G 5/00* (2006.01)

(52) U.S. Cl.
CPC ..... *G08G 5/0034* (2013.01)

(58) Field of Classification Search
CPC ..... G08G 5/0034
See application file for complete search history.

(56) References Cited

U.S. PATENT DOCUMENTS 6,134,500 A * 10/2000 Tang ..... G05D 1/0005 73/178 R
10,860,115 B1 * 12/2020 Tran ..... B64D 47/08
(Continued)

FOREIGN PATENT DOCUMENTS

CN 109191925 A 1/2019
CN 111915932 A 11/2020
(Continued)

OTHER PUBLICATIONS

Machine translation of CN108762089B (2018).*
(Continued)

*Primary Examiner* — Jean Paul Cass
(74) *Attorney, Agent, or Firm* — CBM Patent Consulting, LLC

(57) ABSTRACT

A flight trajectory multi-objective dynamic planning method, which belongs to the field of air traffic management, comprises: acquiring a route network structure, a flight segment length, flight level configurations of each flight segment and flow control information in an available airspace of a flight first, establishing a flight trajectory multi-objective dynamic planning model by taking a minimum fuel consumption, a shortest flight time and a minimum number of flight level changes as objectives, further designing a solving algorithm of the flight trajectory multi-objective dynamic planning model, and finally solving the model to form a plurality of strategies of flight trajectory multi-stage decision.

1 Claim, 4 Drawing Sheets

(56) References Cited

U.S. PATENT DOCUMENTS

| | | | | |
|---|---|---|---|---|
| 2009/0112535 | A1* | 4/2009 | Phillips | G06Q 10/06 703/2 |
| 2021/0089055 | A1* | 3/2021 | Tran | B64C 27/20 |
| 2021/0113130 | A1* | 4/2021 | Tran | A61B 5/1032 |

FOREIGN PATENT DOCUMENTS

| | | | | |
|---|---|---|---|---|
| CN | 112489498 | A | 3/2021 | |
| CN | 113112874 | A | 7/2021 | |
| EP | 3357051 | A1 | 8/2018 | |
| WO | WO-0040929 | A1 * | 7/2000 | G05D 1/0005 |
| WO | WO-2016086278 | A1 * | 6/2016 | |
| WO | WO-2022194310 | A1 * | 9/2022 | G08G 5/0034 |

OTHER PUBLICATIONS

Jinfeng Liu "Research on the method of temporary route planning based on shortest path" Wireless Internet Technology No. 2 p. 1-2, Jan. 31, 2017.

* cited by examiner

FLIGHT TRAJECTORY MULTI-OBJECTIVE DYNAMIC PLANNING METHOD

CROSS REFERENCES

This application is the US Continuation Application of International Application No. PCT/CN2022/097768 filed on 9 Jun. 2022 which designated the U.S. and claims priority to Chinese Application No. CN202110947594.7 filed 18 Aug. 2021, the entire contents of each of which are hereby incorporated by reference.

TECHNICAL FIELD

The present invention belongs to the field of air traffic management, and more particularly, to a flight trajectory multi-objective dynamic planning method applicable to air traffic control and air traffic flow management.

BACKGROUND

Trajectory planning in air traffic management generally optimizes flight trajectory with certain objectives according to the conditions of airspace structure, aircraft performance and flight restrictions. The main methods comprise trajectory planning based on airspace grid, trajectory planning based on geometrical shapes in restricted areas, trajectory planning based on fixed waypoints, trajectory planning based on standard entry and departure procedures, and trajectory planning based on free flight. Most of the existing researches aim at shortening the flying range and flight time, reducing flight conflicts, etc., and pay little attention to factors such as flight level changes and airborne waiting, so the trajectory planning is difficult to meet the requirements of four-dimensional trajectory management. In addition, the trajectory planning is mostly used in unmanned aerial vehicle management, but seldom used in control automation systems and air traffic flow management systems. Dynamic planning is an effective method to solve the optimization problem of multi-stage decision-making process, and has a good application effect in the optimal route, resource allocation and other issues. According to the airspace structure and flight process, the flight trajectory is divided into several stages, and a dynamic planning method is used to optimize the decision of each stage to quickly form a decision sequence of trajectory planning. At present, there is a lack of a flight trajectory multi-objective dynamic planning implementation method oriented to four-dimensional trajectory management.

SUMMARY

Object of the present invention: the technical problem to be solved by the present invention is: establishing a flight trajectory multi-objective dynamic planning model by taking a minimum fuel consumption, a shortest flight time and a minimum number of flight level changes as objectives respectively according to conditions such as a route network structure, a flight segment length, flight level configurations of each flight segment and flow control information in an available airspace of a flight, rebuilding the route network structure in the available airspace of the flight according to a solving need, designing a solving algorithm of the flight trajectory multi-objective dynamic planning model, realizing quick generation of a single trajectory planning strategy, reasonably arranging a flight route and a flight level for the flight, and providing an auxiliary decision for scientifically making a flight plan and improving a rerouting efficiency.

In order to solve the foregoing technical problem, the present invention discloses a flight trajectory multi-objective dynamic planning method, comprising the following steps of:

step 1: acquiring a route network structure, a flight segment length, flight level configurations of each flight segment and flow control information in an available airspace of a flight;

step 2: establishing a flight trajectory multi-objective dynamic planning model;

step 3: designing a solving algorithm of the flight trajectory multi-objective dynamic planning model; and step 4: solving the flight trajectory multi-objective dynamic planning model established in the step 2 by using the algorithm designed in the step 3 to form a plurality of strategies of flight trajectory multi-stage decision.

The step 2 comprises:

step 2.1: constructing a stage variable, a state variable and a state transition equation;

step 2.2: establishing a basic equation by taking a minimum fuel consumption as an objective;

step 2.3: establishing a basic equation by taking a shortest flight time as an objective; and step 2.4: establishing a basic equation by taking a minimum number of flight level changes as an objective.

The constructing the stage variable, the state variable and the state transition equation in the step 2.1 is expressed as:

the stage variable k is equal to 1, 2, 3, . . . , and N, N is a maximum number of flight segments comprised in each route from an entry point to an exit point of the available airspace, and both the entry point and the exit point of the available airspace are unique and not identical;

the state variable $s_k$ denotes a waypoint at the beginning of a stage k, and the state variable $s_k$ has a state set that $S_k=\{P_k^i\}$ (i=1, 2, . . . ), $P_k^i$ denotes a waypoint in the available airspace of the flight, at least one element in $S_k$ is an immediately preceding waypoint of any element in $S_{k+1}$ and has a unique flight segment connection, all elements in $S_{k+1}$ have a corresponding element in $S_k$ which is an immediately preceding waypoint of any element in $S_{k+1}$ and has a unique flight segment connection; for any two non-adjacent state variables $s_k$ and $S_{k+a}$, ($a \geq 2$), when $S_k$ comprises an element which is an immediately preceding waypoint of an element in $S_{k+a}$ and has a unique flight segment connection, a−1 virtual waypoints equally distributed by distance are set on the flight segment, dividing the flight segment into a segments, flight level configurations of each flight segment are still the same as the flight segment, and each virtual waypoint belongs to a corresponding state set respectively; and the state transition equation is that $S_{k+1}=u_k(s_k)$, wherein $u_k(s_k)$ denotes a decision variable in the k stage when the state is $s_k$.

The establishing the basic equation by taking the minimum fuel consumption as the objective in the step 2.2 is:

$$\begin{cases} f_k(s_k) = \min\limits_{u_k}\left\{\frac{D_k(s_k, u_k)}{v} C_k^l(s_k, u_k) + f_{k+1}(s_{k+1})\right\}, k = N, N-1, N-2, \ldots, 2, 1 \\ f_{N+1}(s_{N+1}) = 0 \end{cases},$$

wherein, $D_k(s_k,u_k)$ denotes a length of a flight segment between a waypoint of the state $s_k$ and a waypoint of next stage $S_{k+1}$ after adopting a decision $u_k$, $C_k^l(s_k,u_k)$ denotes a fuel consumption per unit time of a first flight level of the flight segment of the flight between the waypoint of the state $s_k$ and the waypoint of next stage $S_{k+1}$ after adopting the decision $u_k$, $1 \le l \le L_k$, and $L_k$ is a number of flight layers of the flight segment between the waypoint of the state $s_k$ and the waypoint of next stage $S_{k+1}$ after adopting the decision $u_k$; and v denotes an average ground velocity of the flight, and $f_k(s_k)$ denotes an optimal indicator function.

The establishing the basic equation by taking the shortest flight time as the objective in the step 2.3 is:

$$\begin{cases} f_k(s_k) = \min\limits_{u_k}\left\{\frac{D_k(s_k, u_k)}{v} + T_k(s_k, u_k) + f_{k+1}(s_{k+1})\right\}, k = N, N-1, N-2, \ldots, 2, 1 \\ f_{N+1}(s_{N+1}) = 0 \end{cases},$$

wherein, $T_k(s_k,u_k)$ denotes an airborne waiting time required for flow control of a waypoint of next stage $S_{k+1}$ after a waypoint of the state $s_k$ adopts a decision $u_k$.

The establishing the basic equation by taking the minimum number of flight level changes as the objective in the step 2.4 is:

$$\begin{cases} f_k(s_k) = \min\limits_{u_k}\{H_k(s_k, u_k) + f_{k+1}(s_{k+1})\}, k = N, N-1, N-2, \ldots, 2, 1 \\ f_{N+1}(s_{N+1}) = 0 \end{cases},$$

wherein, $H_k(s_k,u_k)$ denotes a flight level difference between a waypoint of the state $s_k$ adopting a decision $u_k$ and a decision $u_{k-1}$ of the previous stage, which is valued as 0 when the flight levels are the same, and valued as 1 when the flight levels are different.

The step 3 comprises:

step 3.1: rebuilding the route network structure in the available airspace of the flight according to a solving need, wherein a flight segment exists between any waypoint $P_k^i$ in the state set that $S_k=\{P_k^i\}$ (i=1, 2, . . . ) of the state variable $s_k$ and a waypoint $P_{k+1}^j$ in a set that Sk $S_{k+1}=\{P_{k+1}^j\}$ (j=1, 2, . . . ) of next stage $s_{k+1}$, the flight segment has $L_k^i$ flight levels, and a flight segment with the waypoint $P_{k+1}^j$ as an origin has $L_{k+1}^j$ flight levels in total; generating $L_k^i-1$ virtual waypoints $P_k^i$ for the waypoint $P_k^i$; and generating $L_{k+1}^j-1$ virtual waypoints $P_{k+1}^j$ for the waypoint $P_{k+1}^j$; wherein flight segments are generated between each original and virtual waypoint $P_k^i$ and each original and virtual waypoint $P_{k+1}^j$, each flight segment has the same distance and airborne waiting time required for flow control as the original flight segment, has and only has one flight level, and the flight segment between the same original or virtual waypoint $P_k^i$ and the original or virtual waypoint $P_{k+1}^j$ has the same flight level;

step 3.2: normalizing and weighting each objective to form a dimensionless single objective, and establishing the basic equation as follows:

$$\begin{cases} f_k(s_k) = \min\limits_{u_k}\left\{\omega_1 G\left(\frac{D_k(s_k, u_k)}{v} C_k^l(s_k, u_k)\right) + \omega_2 G\left(\frac{D_k(s_k, u_k)}{v} + T_k(s_k, u_k)\right)\right. \\ f_{N+1}(s_{N+1}) = 0 + \omega_3 G(H_k(s_k, u_k)) + f_{k+1}(s_{k+1})\}, \end{cases}$$

$$k = N, N-1, N-2, \ldots, 2, 1,$$

wherein, G( ) denotes a normalized function, so that each objective value is in the same order of magnitude, and $\omega_1$, $\omega_2$ and $\omega_3$ denote a weight coefficient of each objective respectively; and step 3.3: constantly changing the weight coefficient of each objective to form different weight coefficient combinations, and solving the single-objective basic equation established in the step 3.2 by using a reverse order method of dynamic planning.

According to the result of the step 4, refined flight trajectory planning or rerouting planning is carried out, and the trajectory management is carried out by a control automation system and an air traffic flow management system.

The flight trajectory multi-objective dynamic planning method according to the present invention is loaded and operated in a processing server of an air traffic flow management system (ATFM system) or a corresponding computer of an air traffic control system (ATC system).

Beneficial Effects

1. An implementation method for refined flight trajectory planning or rerouting planning based on a trajectory operating mode is provided; and 2. a technical support is provided for the development of software such as trajectory management in the control automation system and the air traffic flow management system.

BRIEF DESCRIPTION OF THE DRAWINGS

The advantages of the above and/or other aspects of the present invention will become more apparent by further explaining the present invention with reference to the following drawings and detailed description.

DETAILED DESCRIPTION

The embodiments of the present invention will be described hereinafter with reference to the drawings.

Figure 1:
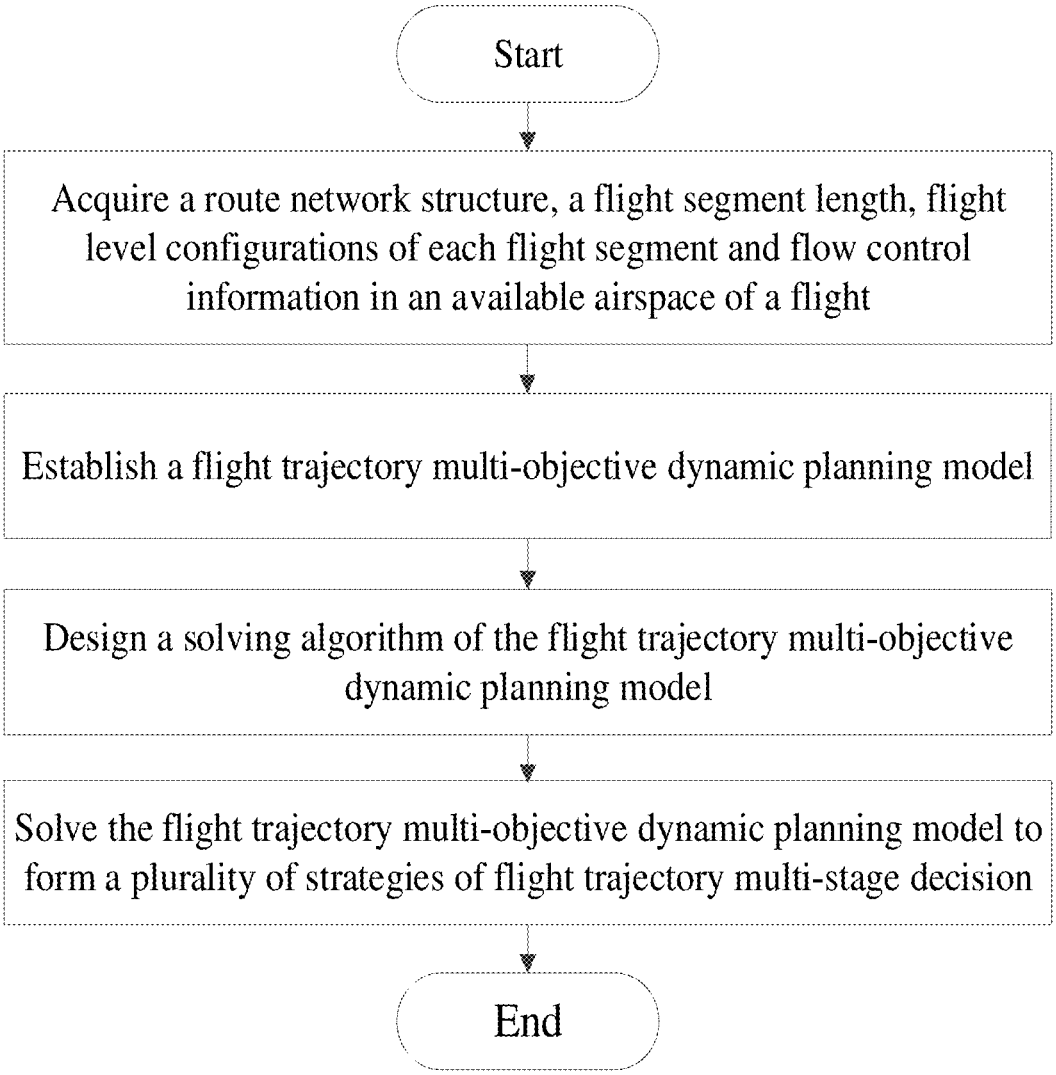
FIG. 1 is a flow chart of a method of the present invention.

As shown in FIG. 1, a flight trajectory multi-objective dynamic planning method, comprises the following steps of:

(1) acquiring a route network structure, a flight segment length, flight level configurations of each flight segment and flow control information in an available airspace of a flight;

(2) establishing a flight trajectory multi-objective dynamic planning model;

(3) designing a solving algorithm of the flight trajectory multi-objective dynamic planning model; and (4) solving the flight trajectory multi-objective dynamic planning model established in the step (2) by using the algorithm designed in the step (3) to form a plurality of strategies of flight trajectory multi-stage decision.

Figure 2:
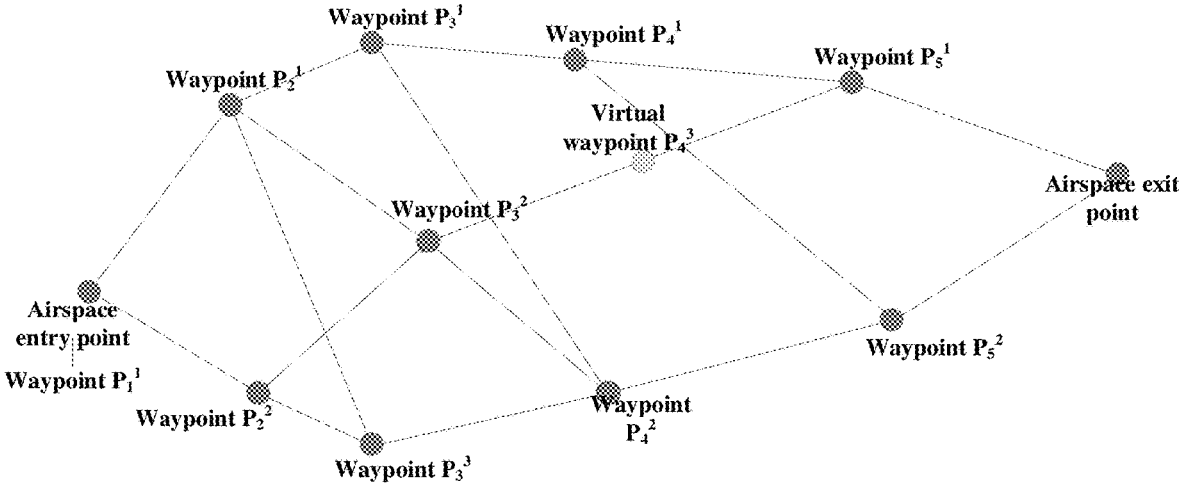
FIG. 2 is a schematic diagram of a route network structure for flight trajectory dynamic planning.

As shown in FIG. 2, during the flight, a plurality of flight segment combinations exist in the route network structure in the available airspace as optional trajectories, and each flight segment may possibly have a plurality of flight levels. Flow control is implemented in some waypoints due to flight deployment and other reasons, so that flights passing through these waypoints may have a certain airborne waiting time, which needs to optimize the selection of flight segments to realize the best trajectory planning.

The constructing the stage variable, the state variable and the state transition equation in the step 2 is expressed as:

the stage variable k is equal to 1, 2, 3, . . . , and N, N is a maximum number of flight segments comprised in each route from an entry point to an exit point of the available airspace, and both the entry point and the exit point of the available airspace are unique and not identical;

the state variable $s_k$ denotes a waypoint at the beginning of a stage k, and the state variable $s_k$ has a state set that $S_k=\{P_k^i\}$ (i is an natural number, and i=1, 2, . . . ), $P_k^i$ denotes a waypoint in the available airspace of the flight, at least one element in $S_k$ is an immediately preceding waypoint of any element in $S_{k+1}$ and has a unique flight segment connection, all elements in $S_{k+1}$ have a corresponding element in $S_k$ which is an immediately preceding waypoint of any element in $S_{k+1}$ and has a unique flight segment connection; as shown in FIG. 2, for any two non-adjacent state variables $s_k$ and $s_{k+a}$ ($a\geq 2$), when $S_k$ comprises an element which is an immediately preceding waypoint of an element in $S_{k+a}$ and has a unique flight segment connection, a−1 virtual waypoints equally distributed by distance are set on the flight segment, dividing the flight segment into a segments, flight level configurations of each flight segment are still the same as the flight segment, and each virtual waypoint belongs to a corresponding state set respectively; and the state transition equation is that $s_{k+1}=u_k(s_k)$, wherein $u_k(s_k)$ denotes a decision variable in the k stage when the state is $s_k$.

The establishing the basic equation by taking the minimum fuel consumption as the objective in the step 3 is:

$$\begin{cases} f_k(s_k) = \min\limits_{u_k}\left\{\dfrac{D_k(s_k, u_k)}{v} C_k^l(s_k, u_k) + f_{k+1}(s_{k+1})\right\}, k = N, N-1, N-2, \ldots, 2, 1 \\ f_{N+1}(s_{N+1}) = 0 \end{cases},$$

Figure 3:
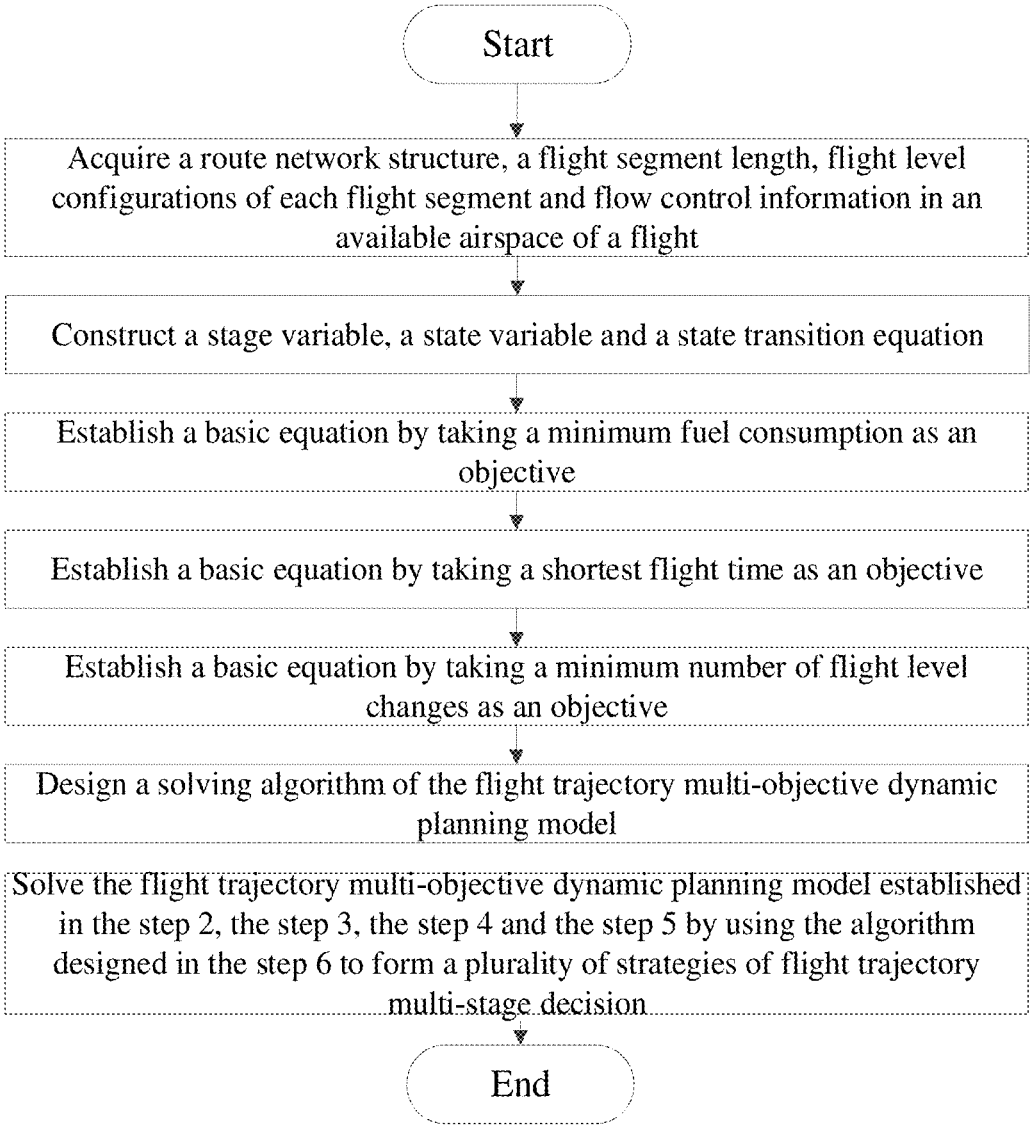
FIG. 3 is a flow chart of specific implementations of the present invention.

The present invention discloses a flight trajectory multi-objective dynamic planning method, the specific implementation process of which is shown in FIG. 3, comprising the following steps of:

step 1: acquiring a route network structure, a flight segment length, flight level configurations of each flight segment and flow control information in an available airspace of a flight;

step 2: constructing a stage variable, a state variable and a state transition equation;

step 3: establishing a basic equation by taking a minimum fuel consumption as an objective;

wherein, $D_k(s_k,u_k)$ denotes a length of a flight segment between a waypoint of the state $s_k$ and a waypoint of next stage $S_{k+1}$ after adopting a decision $u_k$, $C_k^l(s_k,u_k)$ denotes a fuel consumption per unit time of a first flight level of the flight segment of the flight between the waypoint of the state $s_k$ and the waypoint of next stage $S_{k+1}$ after adopting the decision $u_k$, $1\leq l\leq L_k$, and $L_k$ is a number of flight layers of the flight segment between the waypoint of the state $s_k$ and the waypoint of next stage $S_{k+1}$ after adopting the decision $u_k$; and v denotes an average ground velocity of the flight, and $f_k(s_k)$ denotes an optimal indicator function.

The establishing the basic equation by taking the shortest flight time as the objective in the step 4 is:

$$\begin{cases} f_k(s_k) = \min\limits_{u_k}\left\{\dfrac{D_k(s_k, u_k)}{v} + T_k(s_k, u_k) + f_{k+1}(s_{k+1})\right\}, k = N, N-1, N-2, \ldots, 2, 1 \\ f_{N+1}(s_{N+1}) = 0 \end{cases},$$

step 4: establishing a basic equation by taking a shortest flight time as an objective; and step 5: establishing a basic equation by taking a minimum number of flight level changes as an objective;

step 6: designing a solving algorithm of the flight trajectory multi-objective dynamic planning model; and step 7: solving the flight trajectory multi-objective dynamic planning model established in the step 2, the step 3, the step 4 and the step 5 by using the algorithm designed in the step 6 to form a plurality of strategies of flight trajectory multi-stage decision.

wherein, $T_k(s_k,u_k)$ denotes an airborne waiting time required for flow control of a waypoint of next stage $S_{k+1}$ after a waypoint of the state $s_k$ adopts a decision $u_k$.

The establishing the basic equation by taking the minimum number of flight level changes as the objective in the step 5 is:

$$\begin{cases} f_k(s_k) = \min\limits_{u_k}\{H_k(s_k, u_k) + f_{k+1}(s_{k+1})\}, k = N, N-1, N-2, \ldots, 2, 1 \\ f_{N+1}(s_{N+1}) = 0 \end{cases},$$

wherein, $H_k(s_k,u_k)$ denotes a flight level difference between a waypoint of the state $s_k$ adopting a decision $u_k$ and a decision $u_{k-1}$ of the previous stage, which is valued as 0 when the flight levels are the same, and valued as 1 when the flight levels are different.

Figure 4:
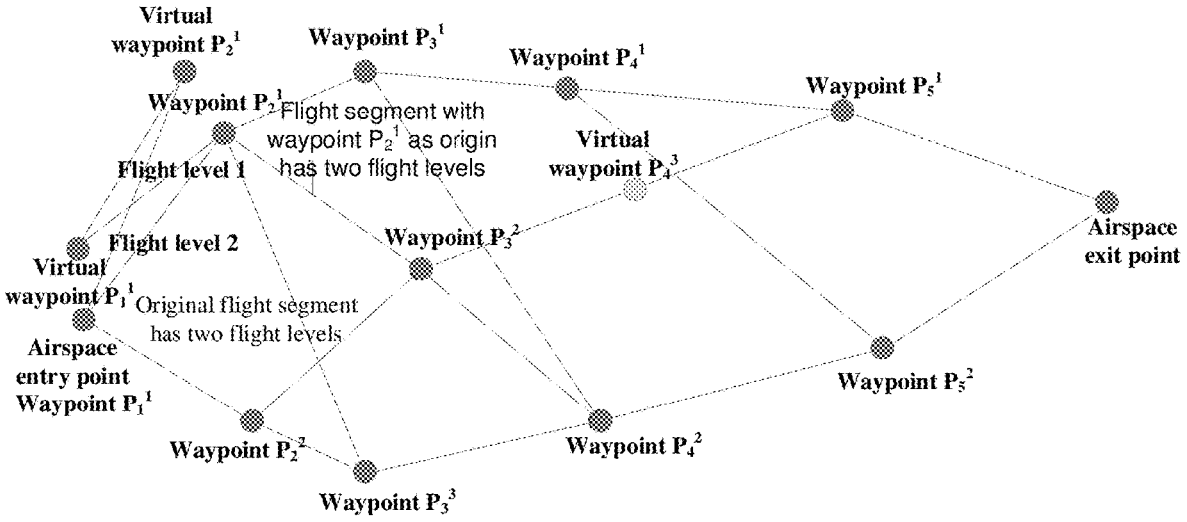
FIG. 4 is a schematic diagram of rebuilding the route network structure for flight trajectory dynamic planning.

The solving algorithm of the flight trajectory multi-objective dynamic planning model in the step 6 comprises:

step 6.1: rebuilding the route network structure in the available airspace of the flight according to a solving need, wherein a flight segment exists between any waypoint $P_k^i$ in the state set that $S_k=\{P_k^i\}$ (i=1, 2, . . . ) of the state variable $s_k$ and a waypoint $P_{k+1}^j$ in a set that Sk $S_{k+1}=\{P_{k+1}^j\}$ (j=1, 2, . . . ) of next stage $s_{k+1}$, the flight segment has $L_k^i$ flight levels, and a flight segment with the waypoint $P_{k+1}^j$ as an origin has $L_{k+1}^j$ flight levels in total; generating $L_k^i-1$ virtual waypoints $P_k^j$ for the waypoint $P_k^i$; and generating $L_{k+1}^j-1$ virtual waypoints $P_{k+1}^j$ for the waypoint $P_{k+1}^j$; wherein flight segments are generated between each original and virtual waypoint $P_k^i$ and each original and virtual waypoint $P_{k+1}^j$, each flight segment has the same distance and airborne waiting time required for flow control as the original flight segment, has and only has one flight level, and the flight segment between the same original or virtual waypoint $P_k^i$ and the original or virtual waypoint $P_{k+1}^j$ has the same flight level, as shown in FIG. 4, a waypoint $P_1^1$ and a waypoint $P_2^1$ are taken as examples;

step 6.2: normalizing and weighting each objective to form a dimensionless single objective, and establishing the basic equation as follows:

$$\begin{cases} f_k(s_k) = \min\limits_{u_k}\left\{\omega_1 G\left(\frac{D_k(s_k, u_k)}{v} C_k^l(s_k, u_k)\right) + \omega_2 G\left(\frac{D_k(s_k, u_k)}{v} + T_k(s_k, u_k)\right) \right. \\ \left. f_{N+1}(s_{N+1}) = 0 + \omega_3 G(H_k(s_k, u_k)) + f_{k+1}(s_{k+1})\right\}, \end{cases}$$

$$k = N, N-1, N-2, \ldots, 2, 1,$$

wherein, G( ) denotes a normalized function, so that each objective value is in the same order of magnitude, and $\omega_1$, $\omega_2$ and $\omega_3$ denote a weight coefficient of each objective respectively; and step 6.3: constantly changing the weight coefficient of each objective to form different weight coefficient combinations, and solving the single-objective basic equation established in the step 6.2 by using a reverse order method of dynamic planning.

The modeling process of the present invention is simple and feasible, and is easy to solve and realize, which is applicable to the development of tools for a control automation system and an air traffic flow management system.

According to the result of the step 4, refined flight trajectory planning or rerouting planning is carried out, and the trajectory management is carried out by a control automation system and an air traffic flow management system.

The flight trajectory multi-objective dynamic planning method according to this embodiment is loaded and operated in a processing server of an air traffic flow management system (ATFM system) or a corresponding computer of an air traffic control system (ATC system).

In a specific implementation, the present application provides a computer storage medium and a corresponding data processing unit, wherein the computer storage medium is capable of storing a computer program, and the computer program, when executed by the data processing unit, can run the inventive contents of the flight trajectory multi-objective dynamic planning method provided by the present invention and some or all steps in various embodiments. The storage medium may be a magnetic disk, an optical disk, a Read Only Storage (ROM) or a Random Access Storage (RAM), and the like.

Those skilled in the art can clearly understand that the technical solutions in the embodiments of the present invention can be realized by means of a computer program and a corresponding general hardware platform thereof. Based on such understanding, the essence of the technical solutions in the embodiments of the present invention or the part contributing to the prior art, may be embodied in the form of a computer program, i.e., a software product. The computer program, i.e., the software product is stored in a storage medium comprising a number of instructions such that a device (which may be a personal computer, a server, a singlechip, a MUU or a network device, and the like) comprising the data processing unit executes the methods described in various embodiments or some parts of the embodiments of the present invention.

The present invention provides the flight trajectory multi-objective dynamic planning method. There are many methods and ways to realize the technical solutions. The above is only the preferred embodiments of the present invention. It should be pointed out that those of ordinary skills in the art can make some improvements and embellishments without departing from the principle of the present invention, and these improvements and embellishments should also be regarded as falling with the scope of protection of the present invention. All the unspecified components in the embodiments can be realized by the prior art.

What is claimed is:

1. A flight trajectory multi-objective dynamic planning method, comprising a computer readable medium operable on a computer with memory for the flight trajectory multi-objective dynamic planning method, and comprising program instructions for executing the following steps of:

step 1: acquiring a route network structure, a flight segment length, flight level configurations of each flight segment and flow control information in an available airspace of a flight;

step 2: establishing a flight trajectory multi-objective dynamic planning model;

step 3: designing a solving algorithm of the flight trajectory multi-objective dynamic planning model;

step 4: solving the flight trajectory multi-objective dynamic planning model established in the step 2 by using the algorithm designed in the step 3 to form a plurality of strategies of flight trajectory multi-stage decision; and step 5: refining flight trajectory planning and/or rerouting planning, and carrying out a trajectory management based on results of the flight trajectory multi-objective dynamic planning method;

wherein the step 2 comprises:

step 2.1: constructing a stage variable, a state variable and a state transition equation;

step 2.2: establishing a first equation by taking a minimum fuel consumption as an objective;

step 2.3: establishing a second equation by taking a shortest flight time as an objective; and step 2.4: establishing a third equation by taking a minimum number of flight level changes as an objective;

the constructing the stage variable, the state variable and the state transition equation in the step 2.1 is expressed as:

the stage variable k is equal to 1, 2, 3, . . . , and N, N is a maximum number of flight segments comprised in each route from an entry point to an exit point of the available airspace, and both the entry point and the exit point of the available airspace are unique and not identical;

the state variable $s_k$ denotes a waypoint at the beginning of a stage k, and the state variable $s_k$ has a state set that $S_k=\{P_k^i\}$, i=1, 2, . . . , $P_k^i$ denotes the waypoint in the available airspace of the flight, at least one element in $S_k$ is an immediately preceding waypoint of any element in $S_{k+1}$ and has a unique flight segment connection, all elements in $S_{k+1}$ have a corresponding element in $S_k$ which is the immediately preceding waypoint of any element in $S_{k+1}$ and has the unique flight segment connection; for any two non-adjacent state variables $s_k$ and $s_{k+a}$, $a \geq 2$, when $S_k$ comprises an element which is the immediately preceding waypoint of an element in $S_{k+a}$ and has the unique flight segment connection, a−1 virtual waypoints equally distributed by distance are set on the flight segment, dividing the flight segment into a segments, flight level configurations of each flight segment are still the same as the flight segment, and each virtual waypoint belongs to a corresponding state set respectively; and the state transition equation is that $s_{k+1}=u_k(s_k)$, wherein $u_k(s_k)$ denotes a decision variable in the k stage when the state is $s_k$;

the establishing the first equation by taking the minimum fuel consumption as the objective in the step 2.2 is:

$$\begin{cases} f_k(s_k) = \min\limits_{u_k}\left\{\dfrac{D_k(s_k, u_k)}{v} C_k^l(s_k, u_k) + f_{k+1}(s_{k+1})\right\}, k = N, N-1, N-2, \ldots, 2, 1 \\ f_{N+1}(s_{N+1}) = 0 \end{cases},$$

wherein, $D_k(s_k,u_k)$ denotes a length of a flight segment between the waypoint of the state $s_k$ and the waypoint of next stage $s_{k+1}$ after adopting a decision $u_k$, $C_k^l(s_k,u_k)$ denotes a fuel consumption per unit time of a first flight level of the flight segment of the flight between the waypoint of the state $s_k$ and the waypoint of next stage $s_{k+1}$ after adopting the decision $u_k$, $1 \leq l \leq L_k$, and $L_k$ is a number of flight layers of the flight segment between the waypoint of the state $s_k$ and the waypoint of next stage $s_{k+1}$ after adopting the decision $u_k$; and v denotes an average ground velocity of the flight, and $f_k(s_k)$ denotes an indicator function;

the establishing the second equation by taking the shortest flight time as the objective in the step 2.3 is:

$$\begin{cases} f_k(s_k) = \min\limits_{u_k}\left\{\dfrac{D_k(s_k, u_k)}{v} + T_k(s_k, u_k) + f_{k+1}(s_{k+1})\right\}, k = N, N-1, N-2, \ldots, 2, 1 \\ f_{N+1}(s_{N+1}) = 0 \end{cases},$$

wherein, $T_k(s_k,u_k)$ denotes an airborne waiting time required for flow control of the waypoint of next stage $s_{k+1}$ after the waypoint of the state $s_k$ adopts a decision $u_k$;

the establishing the third equation by taking the minimum number of flight level changes as the objective in the step 2.4 is:

$$\begin{cases} f_k(s_k) = \min\limits_{u_k}\{H_k(s_k, u_k) + f_{k+1}(s_{k+1})\}, k = N, N-1, N-2, \ldots, 2, 1 \\ f_{N+1}(s_{N+1}) = 0 \end{cases},$$

wherein, $H_k(s_k,u_k)$ denotes a flight level difference between the waypoint of the state $s_k$ adopting a decision $u_k$ and a decision $u_{k-1}$ of the previous stage, which is valued as 0 when the flight levels are the same, and valued as 1 when the flight levels are different;

the step 3 comprises:

step 3.1: rebuilding the route network structure in the available airspace of the flight, wherein a flight segment exists between any waypoint $P_k^i$ in the state set that $S_k=\{P_k^i\}$ of the state variable $s_k$ and the waypoint $P_{k+1}^j$ in a set that Sk $S_{k+1}=\{P_{k+1}^j\}$ of next stage $s_{k+1}$, i=1, 2, . . . , j=1, 2, . . . , the flight segment has $L_k^i$ flight levels, and a flight segment with the waypoint $P_{k+1}^j$ as an origin has $L_{k+1}^j$ flight levels in total; generating $L_k^i-1$ virtual waypoints $P_k^i$ for the waypoint $P_k^i$; and generating $L_{k+1}^j-1$ virtual waypoints $P_{k+1}^j$ for the waypoint $P_{k+1}^j$; wherein flight segments are generated between each original and virtual waypoint $P_k^i$ and each original and virtual waypoint $P_{k+1}^j$, each flight segment has the same distance and airborne waiting time required for flow control as the original flight segment, has and only has one flight level, and the flight segment between the same original or virtual waypoint $P_k^i$ and the original or virtual waypoint $P_{k+1}^j$ has a same flight level;

step 3.2: normalizing and weighting each objective to form a dimensionless single objective, and establishing a forth equation as follows:

$$\begin{cases} f_k(s_k) = \min_{u_k}\left\{\omega_1 G\left(\frac{D_k(s_k, u_k)}{v} C_k^l(s_k, u_k)\right) + \omega_2 G\left(\frac{D_k(s_k, u_k)}{v} + T_k(s_k, u_k)\right) \right. \\ \left. f_{N+1}(s_{N+1}) = 0 + \omega_3 G(H_k(s_k, u_k)) + f_{k+1}(s_{k+1})\right\}, \end{cases}$$

$$k = N, N-1, N-2, \ldots, 2, 1,$$

wherein, G( ) denotes a normalized function, so that each objective value is in a same order of magnitude, and $\omega_1$, $\omega_2$ and $\omega_3$ denote a weight coefficient of each objective respectively; and step 3.3: constantly changing the weight coefficient of each objective to form different weight coefficient combinations, and solving the single-objective equation established in the step 3.2 by using an inverse method of dynamic planning.

* * * * *